US005464156A

United States Patent [19]

Ricco et al.

[11] Patent Number: 5,464,156

[45] Date of Patent: Nov. 7, 1995

[54] ELECTROMAGNETIC FUEL INJECTION VALVE

[75] Inventors: Mario Ricco; Giovanni Bruni, both of Bari; Sisto L. De Matthaeis, Modugno, all of Italy

[73] Assignee: Elasis Sistema Ricerca Fiat Nel Mizzogiorno Societa Consortile Per Azioni, Pomigliano D'Arco, Italy

[21] Appl. No.: 259,742

[22] Filed: Jun. 13, 1994

Related U.S. Application Data

[63] Continuation of Ser. No. 994,895, Dec. 22, 1992, abandoned.

[30] Foreign Application Priority Data

Dec. 24, 1991 [IT] Italy ..... TO91A1043

[51] Int. Cl.[6] ..... F02M 47/02

[52] U.S. Cl. ..... 239/124; 239/533.8; 239/585.1

[58] Field of Search ..... 239/900, 585.1–585.5, 239/533.8, 96; 251/129.15

[56] References Cited

U.S. PATENT DOCUMENTS

| | | | |
|---|---|---|---|
| 3,610,529 | 10/1971 | Huber | 239/533.8 X |
| 3,680,782 | 8/1972 | Monpetit et al. | 239/533.8 X |
| 4,339,082 | 7/1982 | Raedelli et al. | 239/585.4 |
| 4,516,730 | 5/1985 | Fussier | 239/533.8 |
| 4,946,106 | 8/1990 | Turchi et al. | 239/96 X |
| 4,993,637 | 2/1991 | Kanessaka | 239/96 |
| 5,011,082 | 4/1991 | Ausiello et al. | 239/96 X |
| 5,088,647 | 2/1992 | Yoshida et al. | 239/533.8 X |
| 5,125,575 | 6/1992 | Iwanaga | 239/96 |
| 5,141,164 | 8/1992 | Ohno et al. | 239/585.2 |
| 5,154,350 | 10/1992 | Ausiello et al. | 239/533.8 X |

FOREIGN PATENT DOCUMENTS

| | | | |
|---|---|---|---|
| 4115477 | 11/1991 | Denmark | 239/533.8 |
| 48903 | 3/1989 | European Pat. Off. | 234/533.8 |
| 331198 | 9/1989 | European Pat. Off. . | |
| 385399 | 9/1990 | European Pat. Off. . | |
| 450532 | 10/1991 | European Pat. Off. . | |
| 0484804 | 5/1992 | European Pat. Off. . | |
| 0483770 | 5/1992 | European Pat. Off. . | |
| 3008209 | 9/1981 | Germany | 239/533.8 |
| 798340 | 1/1981 | U.S.S.R. | 239/96 |

*Primary Examiner*—Andres Kashnikow
*Assistant Examiner*—Kevin Weldon
*Attorney, Agent, or Firm*—Ladas & Parry

[57] ABSTRACT

A valve controlled by an electromagnetic metering valve comprising a head having a control chamber, a supply conduit, and a drain conduit. The head also presents a cavity communicating with the supply conduit and in which a portion of the moving element for closing the injection orifice slides in such a manner as to choke the supply conduit during injection. The supply conduit communicates with a receiving chamber located between a seat in the body of the valve and the outer surface of an appendix on the head; and the moving element is pushed into the closed position by the combined action of the pressure at each end, and a spring located close to the injection chamber.

7 Claims, 2 Drawing Sheets

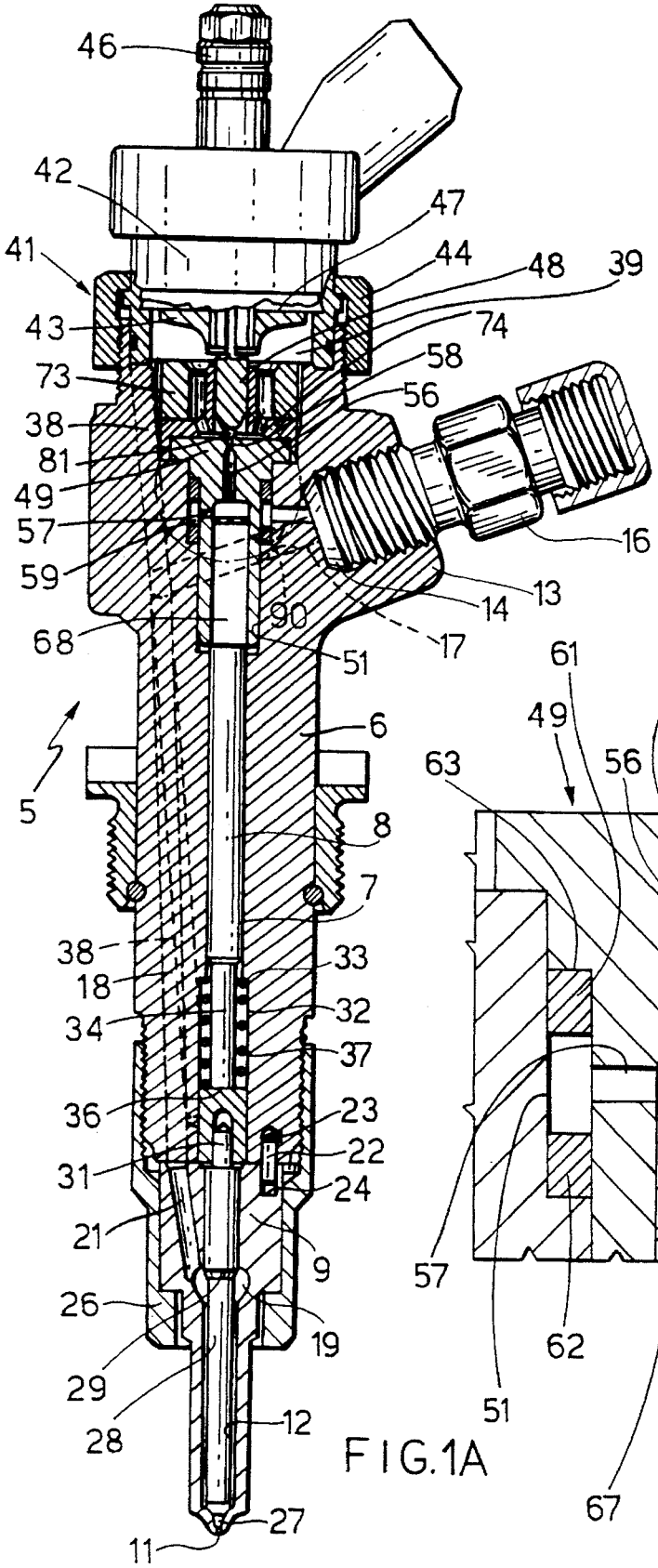
FIG. 1A
FIG. 5
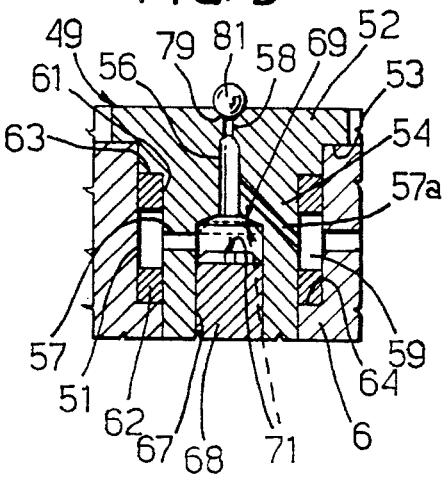
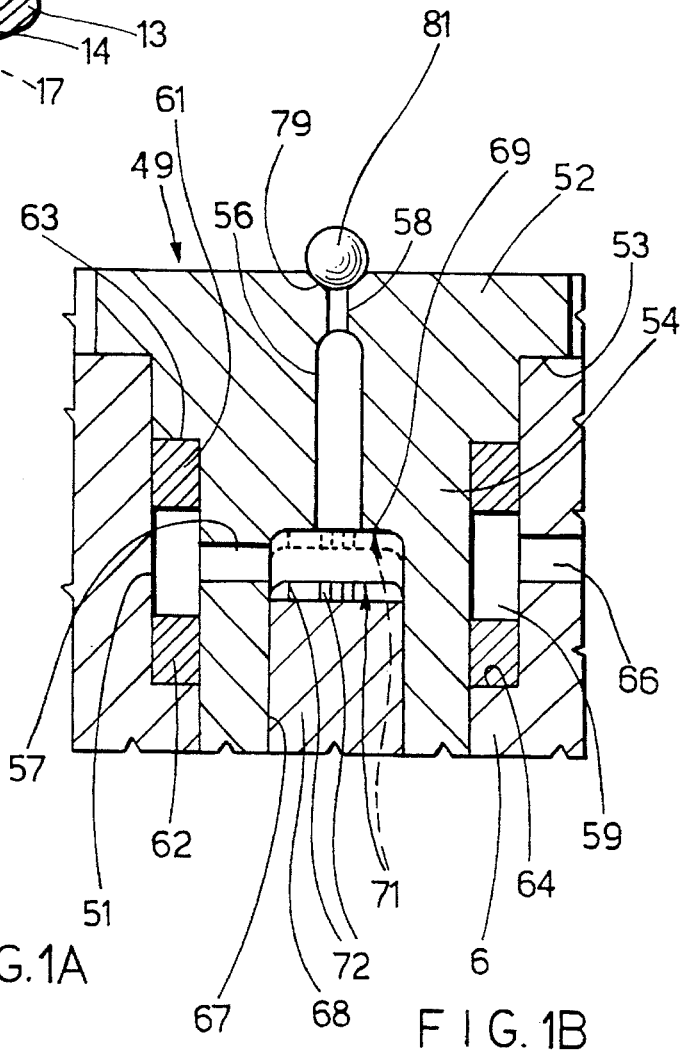
FIG. 1B

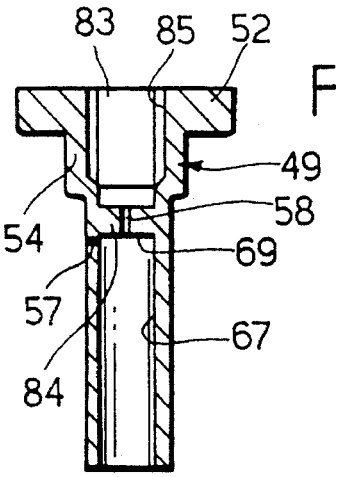
FIG. 4
FIG. 2
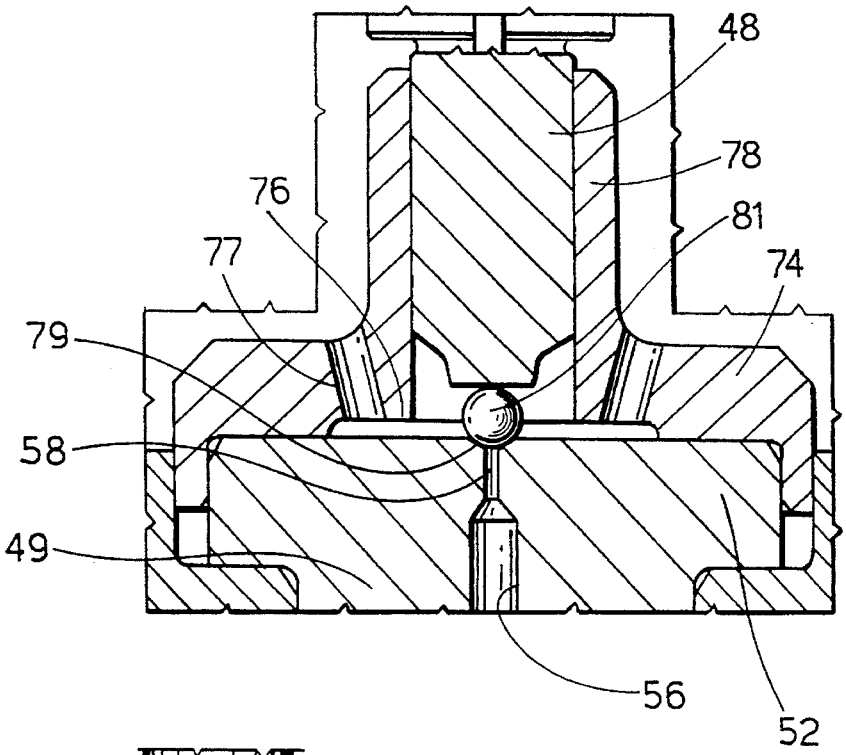
FIG. 3
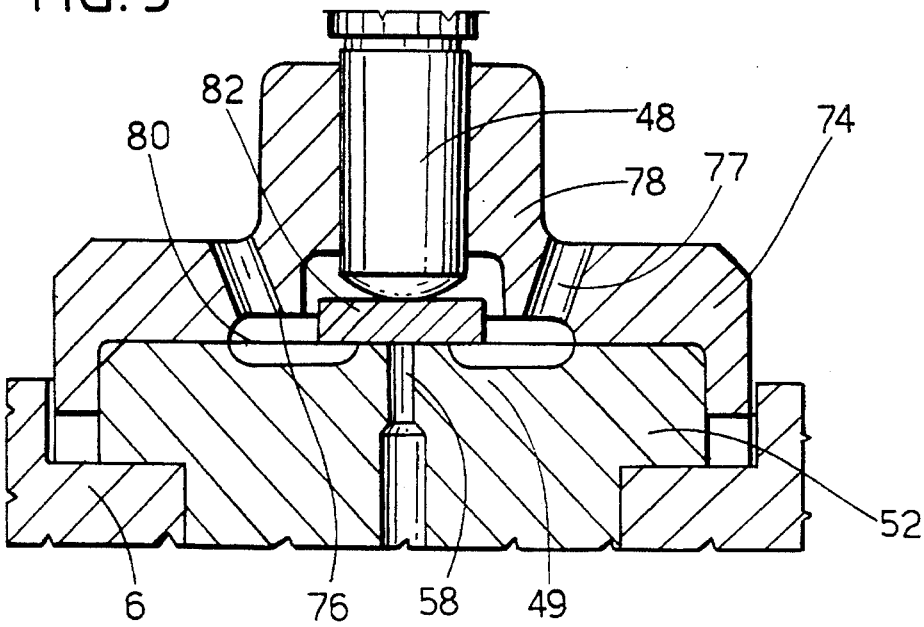

ELECTROMAGNETIC FUEL INJECTION VALVE

This is a continuation of application Ser. No. 07/994,895 filed on Dec. 22, 1993 now abandoned.

BACKGROUND OF THE INVENTION

The present invention relates to an electromagnetic fuel injection valve comprising a body fitted with a nozzle having at least one orifice communicating with an injection chamber supplied with pressurized fuel, and a metering valve controlled by an electromagnet.

On valves of the aforementioned type, the electromagnetic metering valve normally comprises a head having a control chamber, which is normally pressurized for closing the nozzle by means of a stopper. When the metering valve is opened, the pressure in the control chamber falls so as to move the stopper and open the nozzle.

Various injection valves of the aforementioned type are known, on one of which, the head of the metering valve comprises an appendix coaxial with the control chamber, and the injection valve body presents a passage for guiding the moving element of the injection valve, and which communicates with the control chamber via a conduit in the head. The injection valve body is formed in two parts connected to each other, and a red on the moving element is pushed into the closed position by a compression spring housed in a seat adjacent to the guide passage. The head also presents an axial appendix having an annular groove, which forms a receiving chamber communicating with the control chamber via a supply conduit.

The above injection valve presents several drawbacks. Firstly, the rod guide passage in the injection valve body requires accurate machining of the body. Secondly, the rod must be arrested inside the guide passage by a calibrated ring. Thirdly, difficulty is encountered in achieving effective pressure sealing of the fuel between the inlet chamber and the guide passage. Fourthly, the supply conduit remains wide open even when the metering valve is open, thus resulting in drainage of a large amount of fuel, which must subsequently be recovered. And last but not least, the lateral thrust produced by the spring results in frequent jamming of the rod.

SUMMARY OF THE INVENTION

It is an object of the present invention to provide a highly straightforward, reliable injection valve designed to overcome the aforementioned drawbacks typically associated with known valves.

According to the present invention, there is provided an injection valve wherein the metering valve comprises a head having a control chamber, a supply conduit for feeding pressurized fuel into said control chamber, and a drain conduit; the orifice normally being maintained closed by a pin and by the pressurized fuel in said control chamber; characterized by the fact that said head also comprises a cylindrical cavity communicating with said control chamber and guiding a cylindrical element controlling said pin.

BRIEF DESCRIPTION OF THE DRAWINGS

A preferred non-limiting embodiment of the present invention will be described with reference to the accompanying drawings, in which:

FIGS. 1A and 1B show a half section of an injection valve in accordance with the present invention and an enlarged portion thereof, respectively;

FIG. 1B shows an enlarged view of The Head;

FIG. 2 shows a partial larger-scale section of a detail in FIG. 1A;

FIG. 3 shows a section of a variation of the FIG. 2 detail;

FIG. 4 shows a section of a further detail on the injection valve, according to a further variation of the present invention;

FIG. 5 shows a section of a detail on the FIG. 1A valve, according to a further variation of the present invention.

DETAILED DESCRIPTION OF THE INVENTION

Number 5 in FIG. 1A indicates a fuel injection valve for an internal combustion engine, e.g. a diesel engine. Injection valve 5 comprises a hollow, externally tapered body 6 preferably formed in one piece and having an axial cavity 7 in which slides a control rod 8 forming part of the usual moving element of injection valve 5. At the bottom, body 6 is fitted with a nozzle 9 terminating with one or more injection orifices 11 communicating with an axial cavity 12.

Body 6 also presents an appendix 13 having one or more holes 14 housing one or more supply fittings 16 connected in known manner to a normal high-pressure, e.g. 1200 bar, fuel supply pump. At least one of holes 14 communicates with a first inclined conduit 17 in turn communicating with a second conduit 18 substantially extending along body 6.

Nozzle 9 in turn presents a small injection chamber 19 communicating with cavity 12. According to a variation of the present invention, upstream from injection chamber 19, supply conduit 18 presents a calibrated diaphragm 90 for reducing the pressure in chamber 19 to slightly below line pressure and so accelerating closure of the nozzle at the end of the injection phase. Nozzle 9 also presents a conduit 21 located at conduit 18 and communicating with chamber 19.

Nozzle 9 is positioned on body 6, with cavity 12 and conduit 21 respectively aligned with cavity 7 and conduit 18, by means of locating pins 22 engaged inside respective locating holes 23, 24 formed respectively in body 6 and nozzle 9, and is secured to body 6 by a ring nut 26 screwed on to the same.

Orifice 11 is normally maintained closed by a stopper consisting of the substantially conical tip 27 of a pin 28 forming part of the moving element of injection valve 5 and sliding inside cavity 12. Pin 28 presents a shoulder 29 on which the pressurized fuel inside chamber 19 acts for opening orifice 11 as explained in more detail later on. Pin 28 is connected to control rod 8 by a pin 31 and a plate 36, or may be formed in one piece with red 8, in which case, plate 36 is dispensed with.

Cavity 7 of body 6 presents a portion 32 substantially adjacent to nozzle 9 and terminating at the top with a shoulder 33; and rod 8 presents a smaller-diameter portion 34 contacting plate 36. Between shoulder 33 and plate 36, there is provided a compression spring 37, the pressure exerted by which is less than that exerted by the fuel on shoulder 29, but which contributes towards pushing pin 28 downwards. Body 6 also presents a further conduit 38 connecting portion 32 of cavity 7 to a drain chamber 39, for assisting the sliding action of rod 8 inside cavity 7.

Injection valve 5 also comprises a metering valve indicated as a whole by 41 and in turn comprising an electromagnet 42 controlling an armature 43. Electromagnet 42 is fitted to body 6 by means of a further ring nut 44, and presents a drain fitting 46 connected in known manner to the fuel tank. Armature 43 is pushed down by a spring, presents a radial groove 47 connecting fitting 46 to chamber 39, and is connected rigidly to an actuator controlling metering valve 41 and consisting of a cylindrical stem 48.

Metering valve 41 also comprises as seen in FIG 1A, a head 49 housed inside a seat 51 formed in body 6 and coaxial with cavity 7. More specifically, as shown in FIG 1B, head 49 comprises a flange 52 normally resting on shoulder 53 of body 6; and a cylindrical appendix 54 housed inside seat 51. Head 49 presents an axial control chamber 56 communicating with a calibrated radial supply conduit 57 and with a calibrated axial drain conduit 58, and may be formed to advantage from compacted, sintered metal powder.

Supply conduit 57 communicates with a receiving chamber 59 formed between seat 51 and the lateral surface of appendix 54, and defined axially by two annular seals 61, 62 fitted between appendix 54 and seat 51. Seals 61, 62 are separated axially, and rest respectively on shoulder 63 of appendix 54 and shoulder 64 of seat 51. Receiving chamber 59 communicates with at least one of holes 14 via a radial conduit 66 in body 6. By virtue of the ample mating surface, with no relative movement, between the outer surface of appendix 54 and the smaller-diameter bottom portion of seat 51, and by virtue of seal 62 resting on shoulder 64 perpendicular to the axis of body 6, any possibility of fuel leakage from conduit 66 into seat 51 is prevented.

According to one characteristic of the present invention, appendix 54 extends downwards, and presents a cylindrical cavity or seat 67 communicating with control chamber 56 and in which slides a top cylindrical portion 68 of rod 8. Supply conduit 57 is located close to the blend surface 69 between seat 67 and control chamber 56, so that the gap between surface 69 and the top surface 71 of portion 68 forms an extension of control chamber 56.

Portion 68 is preferably larger in diameter than rod 8, and such that the force generated by the fuel pressure on surface 71 is greater than that generated on shoulder 29 of pin 28, thus providing for effective closure of orifice 11. Surface 71 is arrested against surface 69 of seat 67, as shown by the dotted line in FIG. 1, so that surface 69 acts as a stop surface for rod 8.

To prevent total elimination of the gap between portion 68 and surface 69, surface 71 presents a number of grooves 72, e.g. radial grooves, so that, when portion 68 of rod 8 is arrested against surface 69, the lateral surface of portion 68 partially closes supply conduit 57, thus choking fuel flow towards drain conduit 58, and metering valve 41 thus acts substantially as a three-way valve.

Head 49 is secured to body 6 by a ring nut 73 screwed into a threaded seat in body 6 and acting on a bell-shaped member 74 having a depression 76 (FIG. 2) communicating with the drain chamber 39 via holes 77. Bell-shaped member 74 forms one piece with a sleeve 78 for guiding stem 48, and drain conduit 58 in head 49 terminates at the top with a conical portion 79 engaged by a ball type stopper 81 controlled by stem 48.

In the FIG. 3 variation, drain conduit 58 is engaged by a stopper consisting of a plate 82, so that conical portion 79 of conduit 58 is eliminated; and the upper surface of flange 52 presents an annular groove 80 for increasing the volume of the chamber formed by depression 76.

The injection valve described operates as follows.

Electromagnet 42 is normally de-energized, so that armature 43 is maintained by its spring in the FIG. 1A position; ball 81 or plate 82 (FIGS. 2 and 3) are positioned by stem 48 so as to close drain conduit 58; control chamber 56 is therefore pressurized and, together with the pressure exerted by spring 37, overcomes that exerted on shoulder 29; and rod 8 is held down, together with pin 28, so that tip 27 closes orifice 11.

When electromagnet 42 is energized, armature 43 is raised, so that stem 48 releases stopper 81 or 82; and the fuel pressure inside chamber 56 opens metering valve 41, thus draining the fuel through holes 77 into drain chamber 39 and back to the tank.

At this point, the fuel pressure in injection chamber 19, being greater than the pressure remaining in control cheer 56 plus that exerted by spring 37, raises pin 28 together with rod 8. This is ensured, even with a small capacity chamber 19 upstream from the injection orifices, i.e. with no need for accumulating additional fuel and so reducing the pressure beneath shoulder 29, by virtue of the conical portion of drain conduit 58 and ball stopper 81 providing for considerable outflow and so practically eliminating the pressure in chamber 56. When red 8 is arrested against surface 69 of seat 67, tip 27 of pin 28 opens orifice 11, so that the fuel in chamber 19 is injected into the engine; and portion 68 of rod 8 partially closes supply conduit 57, thus minimising the amount of fuel fed into drain chamber 39 via control chamber 56.

When electromagnet 42 is de-energized, armature 43 is moved back down by its spring, so as to close drain conduit 58; the pressurized fuel supplied by conduit 57 via grooves 72 restores the pressure inside chamber 56; and, when the pressure in chamber 56, together with that of spring 37, exceeds the pressure exerted on shoulder 29, moving element 8, 28 again moves down to close orifice 11. The combined action of a small-sized chamber 19 upstream from the injection holes and of a calibrated diaphragm 90 along the supply conduit provides for troublefree downward movement of the moving element, with no substantial difference required in the diameter of portion 68 of rod 8 and shoulder 29 of pin 28, as well as for reducing the specific load on rod 8.

In the FIG. 4 variation, the guide of stem 48 of armature 43 consists of a cylindrical recess 83 formed in head 49 and coaxial with cavity 67, thus eliminating bell-shaped member 74 (FIG. 1A); head 49 presents a diaphragm 84 housing drain conduit 58; and the control chamber consists exclusively of the gap between upper surface 71 of portion 68 and stop surface 69 of cylindrical seat 67.

Cylindrical recess 83 presents axial grooves 85 for enabling communication between the control chamber and drain chamber 39; and stem 48 may of course act on drain conduit 58 by means of a ball 81 or plate 82 type stopper, in the same way as described previously. Operation of the FIG. 4 variation is the same as described with reference to FIGS. 1A–3.

In the FIG. 5 variation, appendix 54 comprises one or more conduits **57*a* conveniently smaller in diameter than supply conduit 57 and such as to enable direct communication between receiving chamber 59 and control chamber 56; and, in place of grooves 72 on portion 68, stop surface 69 of seat 67 and surface 71 of portion 68 are truncated-cone-shaped, tapering at different angles. More specifically, the ideal cone of surface 71 presents a smaller tip angle than that of surface 69. The FIG. 5 variation also provides for minimising the amount of fuel fed from control chamber 56 to drain chamber 39, by virtue of supply conduit 57 being shut off entirely, and fuel flow being determined by the small diameter of conduits 57***a*.

The advantages of the injection valve according to the present invention will be clear from the foregoing description. In particular, it provides for simplifying machining of body 6 by eliminating the need for precision machining of seat 51; and, by virtue of choking supply conduit 57, it provides for reducing the amount of fuel drained along conduit 58 at each injection cycle.

Moreover, the fact that spring 37, via plate 36, acts directly on pin 28 as opposed to rod 8, prevents any possibility of cylindrical portion 68 of rod 8 jamming inside sliding seat 51. Finally, any fuel leakage from receiving chamber 59 through seat 67 in no way impairs the efficiency of the injection valve.

To those skilled in the art it will be clear that changes may be made to the injection valve as described and illustrated herein without, however, departing from the scope of the present invention. For example, spring 37 may be fitted directly to a portion of pin 28 as opposed to plate 36; moving element 8, 28 may be formed in one piece; and, to prevent flexing, in the case of an extremely long rod 8, this may present the same diameter as portion 68.

We claim:

1. An electromagnetic fuel injection valve comprising a body (6) fitted with a nozzle (9) having at least one orifice (11) normally closed by a pin (28); said orifice (11) communicating with an injection chamber (19) for supply with pressurized fuel; and a metering valve (41) controlled by an electromagnet (42); said metering valve (41) comprising a head (49) having a control chamber (56), a supply conduit (57) for feeding the pressurized fuel into said control chamber (56), and a drain conduit (58) coaxial with said control chamber (56); said head (49) also comprising a cylindrical cavity (67) coaxial with said control chamber (56) and communicating therewith; said supply conduit (57) being located radially at said cavity (67); a cylindrical element (68) controlling said said pin (28), being guided by said cylindrical cavity (67) and being urged by the pressurized fuel inside said control chamber (56) to cause said pin (28) to close said orifice (11); said cylindrical element (68) partially closing said supply conduit (57) when said drain conduit (58) is open said cylindrical element (68) being provided with an end surface (71) having grooves (72) for ensuring a residual gap in said cavity (67) communicating with said supply conduit (57), and wherein said drain conduit (58) is connected to a drain chamber (39) by activating a control element (48) integral with an armature (43) of said electromagnet (42); said control element (48) being guided by a cylindrical guide member (83) in one place with said head (49); said drain chamber (39)comprising at least one groove (85) in said guide member (83).

2. An injection valve as claimed in claim characterized by the fact that said guide member (83) consists of a cylindrical recess (83) separated from said cylindrical cavity (67) by a diaphragm (84) supporting said drain conduit (58); said control chamber being formed by part of said cylindrical cavity (67).

3. An electromagnetic fuel injection valve comprising a hollow body (6) defining a first axial cavity (7); a nozzle (9) fitted with said body (6) and having at least one orifice (11) normally closed by a pin (28); said nozzle (9) being provided with a second axial cavity (12) coaxial with said first cavity (7) and movably mounting said pin (28); said pin (28) being operatively associated with a rod (8) movable into said first cavity (7); said orifice (11) communicating with an injection chamber (19) for supply with pressurized fuel; and a metering valve (41) controlled by an electromagnet (42); said metering valve (41) comprising a head (49) having a control chamber (56), a drain conduit (58) coaxial with said control chamber (56), and a cylindrical cavity (67) coaxial with said control chamber (56) and communicating therewith, and a supply conduit (57) located radially at said cylindrical cavity (67) for feeding the pressurized fuel into said control chamber (56); a cylindrical element (68) integral with said rod (8) being guided by said cylindrical cavity (67) and being urged by the pressurized fuel inside said control chamber (56) to cause said pin (28) to close said orifice (11); said cylindrical element (68) being so shaped that, when said drain conduit (58) is open, a lateral surface of said cylindrical element (68) partially closes said supply conduit (57), and an end surface (71) of said cylindrical element (68) contacts a stop surface (69) of said cylindrical cavity (67); said end surface (71) being so formed as to ensure a residual gap in said cylindrical cavity (67) communicating with said supply conduit (57), and wherein said head (49) is provided with an appendix (54) fitted inside a seat (51) in said body (6); said seat (51) being coaxial with said second cylindrical cavity (67), and housing a pair of annular seals (61, 62) for defining an annular fuel receiving chamber (59) communicating with said supply conduit (57); one (62) of said seals (61, 62) resting on a flat shoulder (64) of seat (51), and the other (61) of said seals (61, 62) resting on a flat shoulder (63) of said head (49).

4. An injection valve as claimed in claim 3, wherein said drain conduit (58) is connected to a drain chamber (39) by activating a control element (48) integral with an armature (43) of said electromagnet (42); characterized by the fact that said control element (48) is guided by means (78) axially secured to said head (49) and coaxial with said cylindrical cavity (67).

5. An injection valve as claimed in claim 3, wherein said rod (8) and said pin (28) are held in the closed position with the aid of a compression spring (37) housed in a seat (32) on said rod (8) close to said injection chamber (19).

6. An injection valve as claimed in claim 3, wherein said injection chamber (19) is connected to a pressurized fuel supply conduit (21) via a conduit (17, 18) having a calibrated diaphragm (90).

7. An electromagnetic fuel injection valve comprising a hollow body (6) defining a first axial cavity (7); a nozzle (9) fitted with said body (6) and having at least one orifice (11) normally closed by a pin (28); said nozzle (9) being provided with a second axial cavity (12) coaxial with said first axial cavity (7) and movably mounting said pin (28); said pin (28) being operatively associated with a rod (8) movable into said first axial cavity (7); said orifice (11) communicating with an injection chamber (19) supplied with pressurized fuel; and a metering valve (41) controlled by an electromagnet (42); said metering valve (41) comprising a head (49) having a control chamber (56), a drain conduit (58) coaxial with said control chamber (56), and a cylindrical cavity (67) coaxial with said control chamber (56) and communicating therewith, and a supply conduit (57) located radially at said cylindrical cavity (67) for feeding pressurized fuel into said control chamber (56); a cylindrical element (68) integral with said rod (8) being guided by said cylindrical cavity (67) and being urged by the pressurized fuel inside said control chamber (56) to cause said pin (28) to close said orifice (11); said cylindrical element (68) being so shaped that, when said drain conduit (58) is open, a lateral surface of said cylindrical element (68) closes said supply conduit (57), said cylindrical element (68) having an truncated-cone-shaped end surface (71) facing an end surface (69) of said cylindrical cavity (67) also being truncated-cone-shaped, but tapering at a different angle as compared with the end surface (71) of said cylindrical element (68); said head (49) having at least one further supply conduit (**57*a*) connecting said control chamber (56) directly to an annular fuel receiving chamber (59**).

* * * * *